US008185980B2

(12) United States Patent
Adams et al.

(10) Patent No.: US 8,185,980 B2
(45) Date of Patent: May 29, 2012

(54) MAGNETIC PLASTIC BATHWARE

(75) Inventors: Fred Adams, Huntington Beach, CA (US); Stuart Leigh, Los Angeles, CA (US); Dante San Miguel, Irvine, CA (US); Jose A. Camba, Santa Ana, CA (US); Michael Seymour, Aliso Viejo, CA (US); Bobby McCoy, Fullerton, CA (US)

(73) Assignee: Aquatic Co., Anaheim, CA (US)

( * ) Notice: Subject to any disclaimer, the term of this patent is extended or adjusted under 35 U.S.C. 154(b) by 1231 days.

(21) Appl. No.: 11/933,879

(22) Filed: Nov. 1, 2007

(65) Prior Publication Data

US 2009/0113617 A1 May 7, 2009

(51) Int. Cl.
*A47K 3/00* (2006.01)

(52) U.S. Cl. ..... 4/609; 4/610; 4/584; 4/612

(58) Field of Classification Search ..... 4/609, 610, 4/584, 580, 604, 612; 600/9; 601/154–158
See application file for complete search history.

(56) References Cited

U.S. PATENT DOCUMENTS 548,190 A * 10/1895 Grant ..... 4/610
2,212,326 A * 8/1940 Piken ..... 4/558
3,093,919 A 6/1963 Holtz
3,746,992 A 7/1973 Serembe
4,076,561 A 2/1978 Lee et al.
4,594,741 A 6/1986 Payne
4,888,835 A 12/1989 Baumann
5,005,841 A * 4/1991 Klick ..... 273/348.3
5,119,518 A 6/1992 Marsilio
5,953,771 A 9/1999 VanHuss
6,292,957 B1 * 9/2001 Thompson ..... 4/609
6,353,943 B1 3/2002 Stevens
6,409,091 B1 6/2002 Simpson
6,575,892 B1 6/2003 Lauter
7,179,340 B2 * 2/2007 Komuro et al. ..... 148/302

FOREIGN PATENT DOCUMENTS

CA 2491782 A1 7/2005

* cited by examiner

*Primary Examiner* — William Gilbert
*Assistant Examiner* — Patrick Maestri
(74) *Attorney, Agent, or Firm* — P. N. Dunlap, Esq.; J. A. Thurnau, Esq.; T. A. Dougherty, Esq.

(57) ABSTRACT

A plastic bathing fixture formed substantially or entirely of a laminated composite material comprising a show-surface layer of gel-coat or thermoplastic sheet material which may be non-magnetic; a magnetic or magnetizable layer which may coincide with the show-surface layer or be a subsurface layer; and a non-magnetic structural layer of fiber-reinforced resin material. The magnetic layer materials may be localized or strategically placed, and may comprise a resin with a particulate ferromagnetic filler.

15 Claims, 3 Drawing Sheets

MAGNETIC PLASTIC BATHWARE

BACKGROUND OF THE INVENTION

1. Field of the Invention

This invention relates generally to bathing fixtures such as bathtubs and shower stalls, more particularly to plastic or composite bathware comprising an embedded layer of magnetic material.

2. Description of the Prior Art

The term "bathware" refers to bathing fixtures or bath fixtures such as bathtubs, shower pans, bathing receptacles, shower stalls, and enclosures. The term "plastic bathware" refers to non-metallic bathware made of thermoset organic resins with gel-coated surfaces including materials such as unsaturated polyester resins, polyurethanes or polyureas, or thermoplastic materials such as acrylic, ABS, PVC, PS, PE, HIPS, or PC. Plastic bathware may include fibers or other reinforcements.

Shower enclosures generally require means of preventing water overspray from leaving the enclosure. Various splash guard designs and flexible shower curtains of plastic film material have been used to prevent shower overspray from leaving shower enclosures. Shower curtains, as exemplified by U.S. Pat. Nos. 2,212,326 and 5,953,771, as well as splash guards, as exemplified by U.S. Pat. No. 4,888,835, have been equipped with magnets which are attracted to metal bathware which is typically made of cast iron or steel. The magnets in a shower curtain are typically located along the lower edge of the curtain, closest the floor to keep the curtain in a desired position during use. Magnets have also been placed in vertical curtain edges. Other devices or articles have been equipped with magnets for use in metal tubs, including: toys, as exemplified by U.S. Pat. No. 6,409,091; and mats, as exemplified by U.S. Pat. Nos. 6,353,943 and 6,292,957. Since magnets are useless with conventional plastic bathware, various adaptations for removably holding shower curtains, mats, or toys in place have been proposed, including clamps attached to walls, suction cups, hook and loop systems, strips of metal attached to walls or tubs, permanent adhesives, and the like, as reviewed in U.S. Pat. No. 6,292,957. Each of these approaches has disadvantages over the simple use of magnets to attach items to steel tubs. For example, anything permanently attached to the visible surface of the bathware, such as clamps or hooks or metal plates, may aesthetically degrade the appearance of the surface and make cleaning more difficult. Suction cups are not very effective on textured surfaces and also may be difficult to keep clean. Nevertheless, plastic bathware is desired for its light weight, design versatility, water resistance, and other functionality.

U.S. Pat. No. 6,575,892 discloses a water tub of acrylic and fiberglass having permanent magnets attached to the outside wall surface thereof or sandwiched in the fiberglass for applying a magnetic flux into a human's back placed adjacent to the tub wall.

What is needed is a new type of bathware which retains the advantages of plastic bathware yet functions with simple magnetic attachment systems as incorporated in shower curtains, toys, mats and the like for use with cast iron or steel bathware. It is heretofore not known or suggested to modify the plastic bathware itself to render it magnetic or magnetizable, thus rendering the magnets in bath accessories such as shower curtains once again useful for their intended purposes, such as holding a shower curtain in position. Thus, the prior art fails to disclose a bathing fixture constructed primarily of plastic laminate material and having a magnetic or magnetizable layer embedded therein.

SUMMARY

The present invention is directed to systems and methods which provide a plastic or composite bathing fixture with magnetic properties, enabling the bath fixture to attract and hold magnets or magnetic inserts mounted for example in shower curtains or other bath accessories.

The invention is directed to a plastic bathing fixture comprising a non-magnetic show-surface layer and a magnetic or magnetizable subsurface layer in at least a portion of the fixture. The bathing fixture may further comprise a non-magnetic structural layer. The magnetic layer may reside between the show-surface layer and the structural layer.

The bathing fixture may be in the form of a bathtub, a shower receptor, or a bathtub or shower enclosure including a unitary tub/shower combination enclosure. The non-magnetic show-surface layer may be a gel-coat or a thermoplastic sheet material. The non-magnetic structural layer may be a fiber-reinforced resin material.

In one embodiment, the magnetic subsurface layer may comprise an organic resin mixed with particulate ferromagnetic metal filler. The magnetic layer composition may comprise from 30% to 90% by weight of the ferromagnetic filler. The magnetic layer may be applied to the back side of the show surface and have a thickness of about 0.12 mm (5 mils) to about 2.5 mm (100 mils).

In another embodiment, the magnetic subsurface layer may comprise a ferromagnetic metal sheet. The metal sheet may comprise one or more of iron, tin, steel, nickel, cobalt, or other ferromagnetic alloy.

In another embodiment, the magnetic subsurface layer may comprise a ferromagnetic metal mesh. The mesh layer may comprise a fibrous ferromagnetic metal material in the form of a woven or non-woven fabric or veil or a mesh or screen such as a wire mesh or screen.

In another embodiment, the magnetic subsurface layer may comprise one or more magnets or magnetic materials strategically placed behind the show-surface layer. The one or more magnets may reside between the show-surface layer and the structural layer. Alternately, one or more magnets may reside embedded in the structural layer or on a back surface of the structural layer. The strategic placement of the magnets may facilitate, for example, the use of magnets in shower curtains for holding the curtain in place.

The invention is also directed to a bathing system which includes a bathing fixture as described above and an accessory, such as shower curtain. The accessory has at least one magnet fixed thereto and adapted in size and location to magnetically hold the accessory against a portion of the fixture having the magnetic layer or magnet.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, which are incorporated in and form part of the specification in which like numerals designate like parts, illustrate embodiments of the present invention and together with the description, serve to explain the principles of the invention. In the drawings.

DETAILED DESCRIPTION

Figure 1:
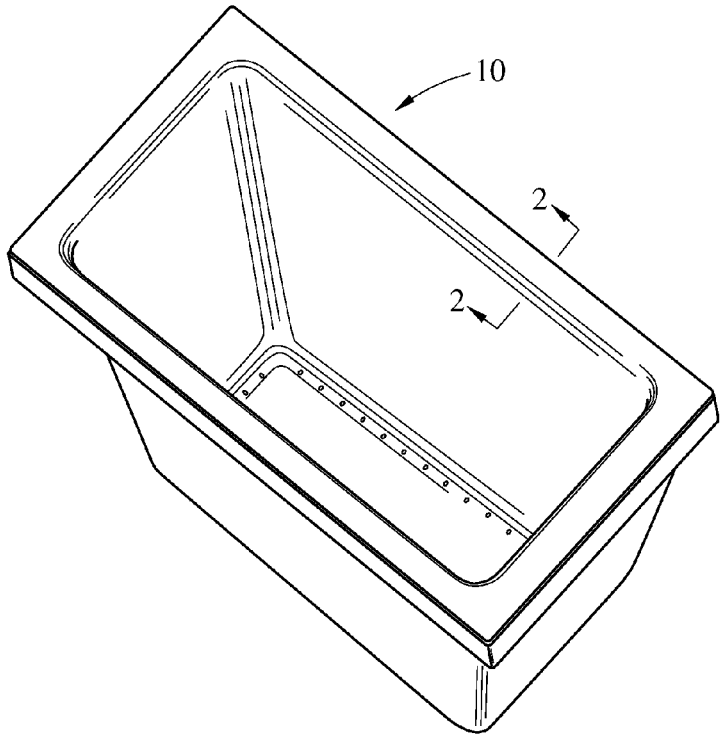
FIG. 1 is a bathing fixture according to an embodiment of the invention.
Figure 7:
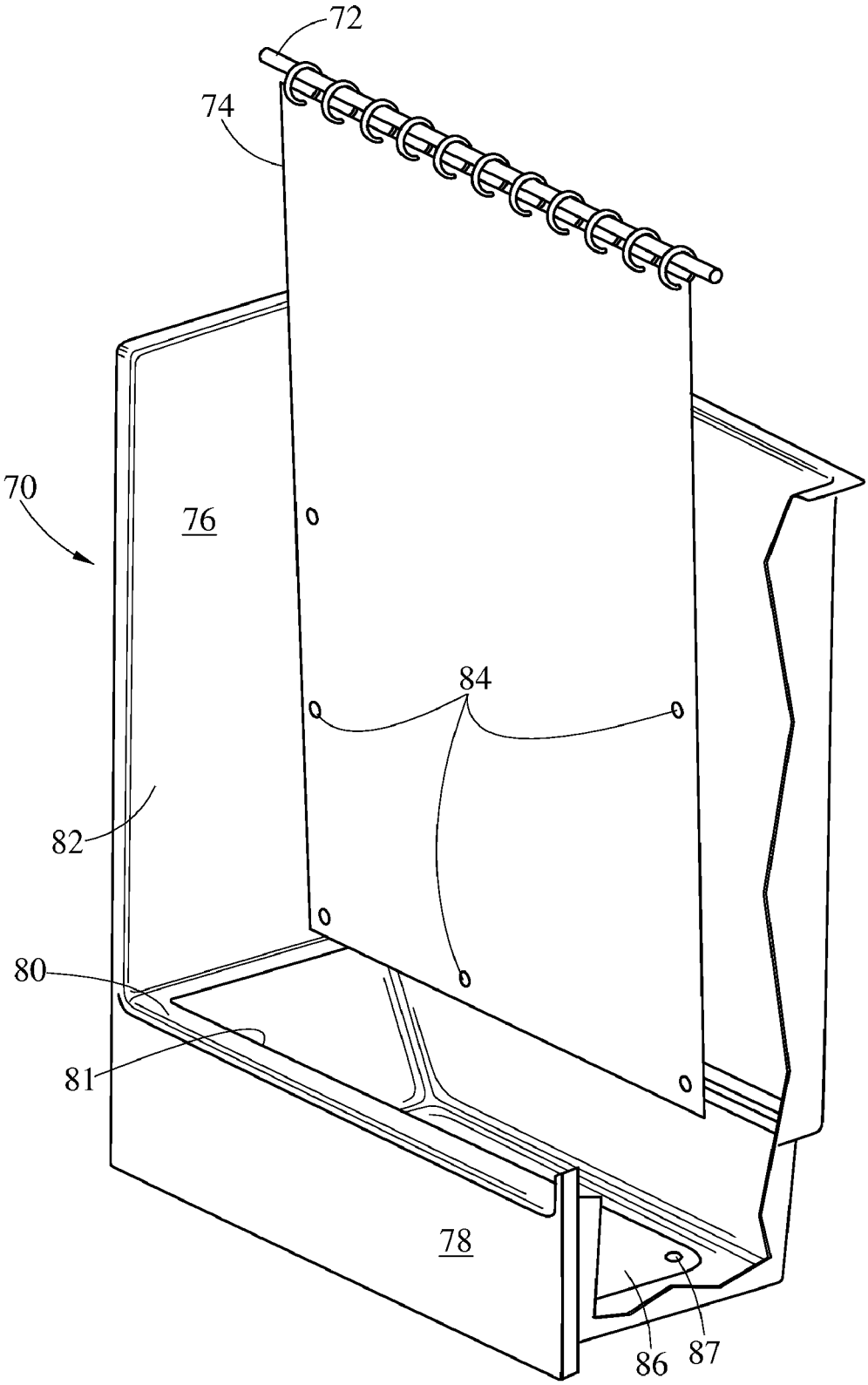
FIG. 7 is a perspective view, partially cut away, of a bathing system according to an embodiment of the invention.

FIG. 1 shows a representative form of plastic bathware. FIG. 1 shows bathtub 10. Other forms of bathware or bathing fixture envisioned include shower pans or receptors and bathing enclosures including shower panels or walls including a multi-piece enclosure or a unitary tub/shower enclosure such as illustrated in FIG. 7. A bathtub may be jetted for circulation of water and/or air. In whatever form, the inventive bathware is primarily made of plastic or reinforced synthetic resin material, but with a layer of magnetic or magnetizable material under the visible surface or show-surface in at least a portion of the fixture. Herein and in the claims, "magnetic" means a material that is attracted by or to a magnet, and may include a magnet. "Magnetizable" means a material that is attracted by or to a magnet, and includes materials that can be rendered magnetic. The term "ferromagnetic" refers to metals with the ability to attract magnets. Useful ferromagnetic metals include, but are not limited to, iron, tin, steel, nickel, cobalt, and other alloys.

FIGS. 2-6 illustrate cross-sectional schematics of various arrangements of the multi-layer plastic laminate material used to form various embodiments of the invention. For each embodiment, there is a show-surface or surface layer 22, shown as the leftmost layer in each of the figures, and a structural layer 26. The term "plastic" herein refers to the presence of synthetic resin materials in the surface and structural layers, and includes various reinforced or compounded resins, whether thermoplastic or thermoset.

The show-surface layer may be a gel coat or a thermoplastic sheet. A gel-coat show-layer is generally of thermoset material such as, but not limited to, unsaturated polyester resins, aliphatic polyurethane, or polyurea resins. Thermoplastic sheet used as a show-layer includes, but is not limited to, acrylic, acrylonitrile-butadiene-styrene (ABS), polyvinyl chloride (PVC), polyethylene (PE), high-impact polystyrene (HIPS), or polycarbonate (PC). The surface layer may include tints, colors, stabilizers, or other ingredients and are generally used in relatively thin layers. A gel-coat layer may be about 0.25 mm (10 mils) to 0.3 mm (12 mils) thick and be backed with a so-called "barrier" layer. A barrier layer may also be about 0.25-0.2 mm (10-12 mils) thick and utilize fewer or no tints or colors, for cost savings. The purpose of the barrier layer may be to provide additional thickness to the gel-coat layer and/or to better hide subsequent layers from view.

The structural layer is generally a thermoset resin such as unsaturated polyester, polyurethane, or epoxy. The structural layer may be reinforced with chopped or continuous fiber, fillers, or rigid inserts. Thus, the structural layer may itself be a composite material or a laminated construction. Examples of fiber used to reinforce the structural layer include chopped glass fiber, woven or non-woven glass fabrics, glass mat, other glass mesh products, organic fibers or fabrics, paper, and the like. Examples of fillers include calcium carbonate, calcium sulfate, talc, glass or polymeric beads, and the like. Examples of rigid inserts may be wood, plastic honeycomb, plastic foam, corrugated paper, and the like.

Figure 2:
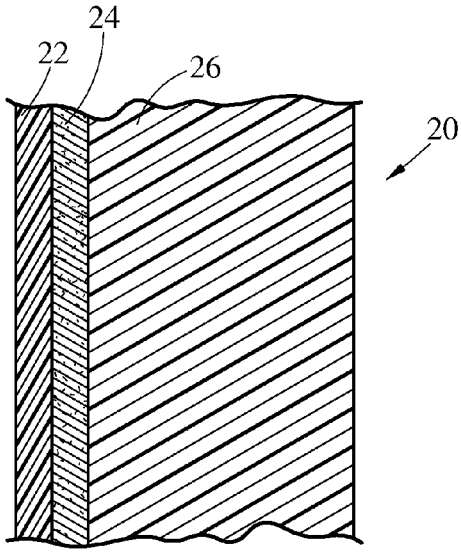
FIG. 2 is a cross-sectional diagram of an embodiment of the invention.

In FIG. 2, magnetic layer 24 resides between show-surface layer 22 and structural layer 26, making up magnetic laminate 20 for use in bathware such as bathtub 10. In one embodiment, magnetic layer 24 is a composition based on ferromagnetic particulate filler. Though not shown, it is conceived that ferromagnetic particulates could be added directly to the show surface layer, rendering the show surface magnetic or magnetizable. Since the properties or appearance of the show surface could be thus affected, it may be preferable to incorporate the magnetic filler in a separate secondary or sub-surface layer as shown in FIG. 2. The sub-surface magnetic layer may function suitably as a barrier layer and therefore replace use of a barrier layer. Typical ferromagnetic fillers may comprise one or more of iron, tin, steel, nickel, cobalt, or other ferromagnetic alloy. Any available and useful particle size or shape may be utilized in preparing the magnetic layer. A useful particle size is minus 325 mesh or smaller. The magnetic layer comprises an organic resin in which the ferromagnetic filler is dispersed or suspended. Proper dispersion may be difficult for particle sizes larger than 325 mesh. The resin may be one of those useful for the structural layer or for the show-surface, and is preferably compatible with and/or bondable to those other layers. Unsaturated polyester resin has been satisfactory for use with a gel-coat show layer and a fiberglass structural layer. The amount of ferromagnetic filler in the magnetic layer composition may be 30 to 90% by weight or about 70% by weight. The magnetic layer may be applied to the back side of the show-surface at a thickness of about 0.12 mm (about 5 mils) to about 2.5 mm (about 100 mils) or from about 0.5 mm (about 20 mils) to about 0.76 mm (about 30 mils). A magnetic layer of 0.5 to 0.76 mm (20 to 30 mils) thickness has been found to provide adequate attraction for typical magnets usable in shower curtains. It should be understood that FIGS. 2-6 are not meant to be scale drawings.

A magnetic accessory, such as a show curtain, and a magnetic layer may be designed to complement to each other, with the magnetic layer thickness and the magnet strength selected for the desired holding force for the accessory. Thus, magnets of somewhat higher strength can be provided in a shower curtain for greater attraction force and/or for use with thinner magnetic layers. Examples of magnets usable with the invention, for example with a shower curtain, may be alnico, ceramic, neodymium, samarium-cobalt, filled plastic or plastic coated, and the like.

Figure 3:
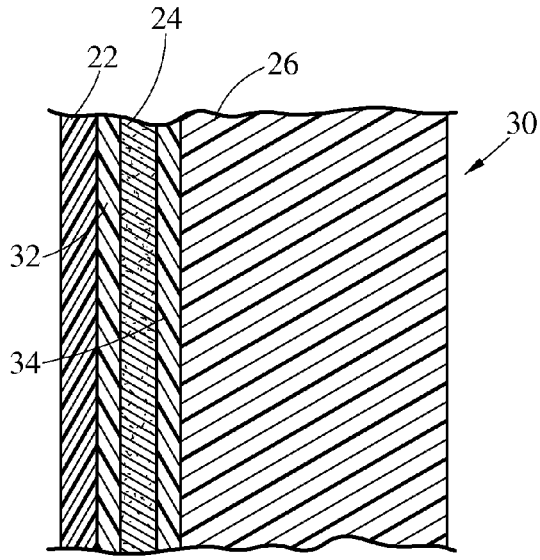
FIG. 3 is a cross-sectional diagram of another embodiment of the invention.

FIG. 3 shows an embodiment having adhesive or resin layers 32 and 34 between magnetic layer 24 and show-surface 22 and between magnetic layer 24 and structural layer 26, respectively, making up magnetic laminate 30 for use in bathware. Alternately, one of the two adhesive layers may be omitted if direct bonding between the relevant layers is sufficient.

In another embodiment, the magnetic layer, as illustrated again by layer 24 in FIG. 2 and FIG. 3, comprises a ferromagnetic metal sheet or film. The composition of the metal sheet may be one or more of iron, tin, steel, nickel, cobalt, or other ferromagnetic alloy or the like. The thickness of the metal sheet may be chosen based on the type of material and its ferromagnetic properties. Adhesive resins in one or more layers and at one or more interfaces may be utilized as needed as illustrated by layers 32 and 34 in FIG. 3. Generally, surface cleanliness and suitable preparation of the metal sheet is very critical to obtaining good adhesion.

In another embodiment, the magnetic layer, as illustrated by layer 24 in FIG. 2 and FIG. 3, comprises a ferromagnetic metal mesh or fibrous material or wire screen. The composition of the metal mesh or fibrous material or wire screen may be one or more of iron, tin, steel, nickel, cobalt, or other ferromagnetic alloy or the like. Any magnetizable metal may be used. The configuration of the screen or mesh is not particularly limited. For example, the mesh or screen may be relatively open, which might facilitate penetration of a resin or adhesive material for bonding to the show-surface and structural layer. The mesh might be of metallic fibers woven in a fabric, analogous to the fiberglass fabrics used for resin reinforcement. The mesh might be of fibrous non-woven mat. The mesh is sandwiched between the show-surface and the structural layer and may include one or more additional layers of thermosetting resin or adhesive resin or thermoplastic resin.

The magnetic layer, whether comprising a magnetic filler, magnetic metal sheet, or mesh, may be applied to the entire bathing fixture, or it may be applied at certain strategic locations. For example, the magnetic layer may be applied to the bottom or floor of a bathtub or shower pan to facilitate use of mats with magnets. The magnetic layer may be strategically applied in the corners of tubs and/or shower pans near the access openings or rim or threshold to facilitate use with shower curtains with magnets in the lower edge and/or corners. The magnetic layer may be strategically applied along an entire edge of an opening, for example along a rim of a tub or along a threshold of a shower pan. The magnetic layer may strategically be applied in wall panels or shower enclosure walls near the access opening of the finished bathing enclosure to facilitate use of shower curtains with magnets in the vertical edges.

Figure 4:
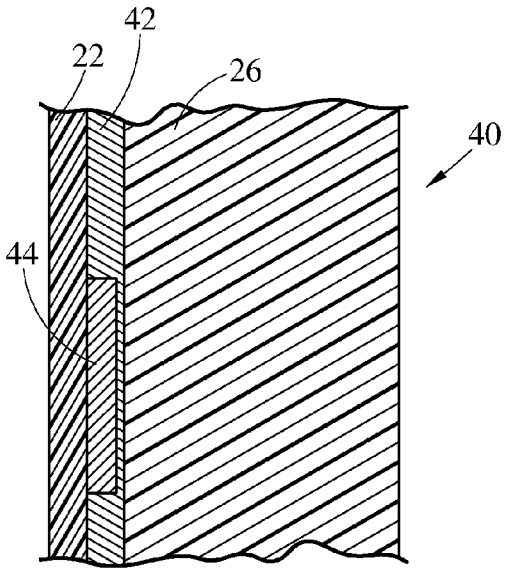
FIG. 4 is a cross-sectional diagram of another embodiment of the invention.
Figure 5:
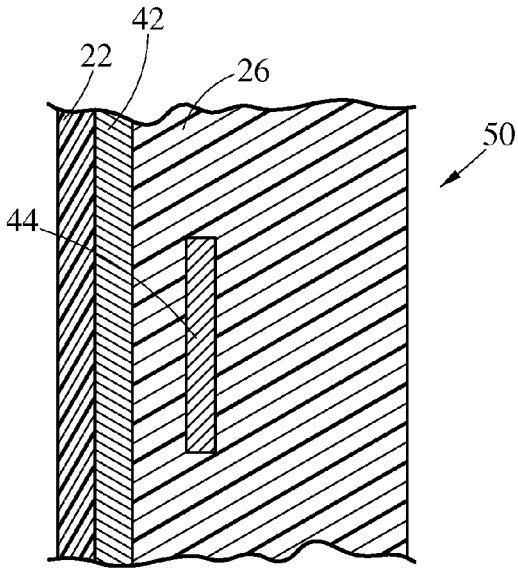
FIG. 5 is a cross-sectional diagram of another embodiment of the invention.
Figure 6:
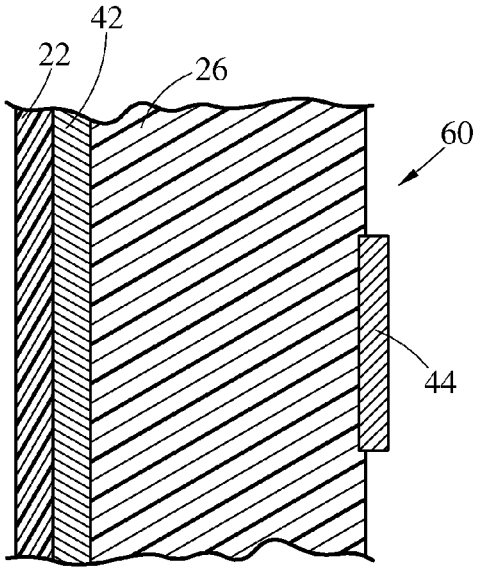
FIG. 6 is a cross-sectional diagram of another embodiment of the invention.

In another embodiment, the magnetic layer comprises one or more magnets or magnetic materials strategically placed behind the show-surface layer. FIG. 4 shows magnet 44 placed between show-surface 22 and structural layer 26, embedded in an optional resin layer 42, making up magnetic laminate 40 for use in bathware. FIG. 5 shows magnet 44 embedded in structural layer 26, which may be bonded directly to show-surface 22, or there may be adhesive or barrier resin layer 42 between show-surface and structural layer, thus making up magnetic laminate 50 for use in bathware. FIG. 6 shows magnet 44 placed on a back surface of structural layer 26, thus making up magnetic laminate 60 for use in bathware. Strategic placement of magnets may be carried out in the same way as described above with respect to magnetic layers comprising ferromagnetic fillers, sheet, or mesh. Examples of usable magnets include alnico, ceramic, neodymium, samarium-cobalt, filled plastic or plastic coated, and the like.

FIG. 7 illustrates a system including a bathing fixture and a magnetic accessory which may be held in place against a surface of the fixture by a magnet located in or on the accessory. Referring to FIG. 7, unitary bath/shower enclosure 70 is shown with shower curtain 74 mounted on rod 72. Enclosure 70 includes side wall 76 and bathtub 78. Sidewall 76, its opposing sidewall (cutaway and not shown in FIG. 7), and rim or threshold 80 define the access opening which the shower curtain is intended to cover. As a magnetic accessory, curtain 74 is shown with magnets 84 mounted therein or thereon in strategic positions for removably attaching the curtain to the fixture surface in a way that prevents water from escaping the enclosure. Thus, magnets on the vertical edges of curtain 74 can attach the curtain to sidewall 76, for example near the edge at location identified by numeral 82, and to the other sidewall not shown. Magnets on the lower edge of curtain 74 can attach the curtain to the inside upper surface 81 of the threshold or rim of the tub 78. Any desired number of magnets may be used. As an example of another magnetic accessory, mat 86 is shown on the tub floor with magnet 87 fixed in or on the mat. Thus, a system embodiment of the invention might include one or more magnetic accessories. It may be noted that one perceived disadvantage of solid metal tubs of the prior art is that the magnets may stick to the tub anywhere, including in undesirable locations such as the outside of the threshold. In the present invention, by strategic placement of the magnetic layer in portions of the fixture, the accessory magnets may advantageously be made to stick only in desirable locations and nowhere else.

Thus, according to the invention, a plastic bathing fixture may be formed substantially or entirely of a laminated composite material comprising a show-surface layer of gel-coat or thermoplastic sheet material which may be non-magnetic; a magnetic or magnetizable layer which may coincide with the show-surface layer or be a subsurface layer; and a non-magnetic structural layer of fiber-reinforced resin material. The magnetic layer materials may be localized or strategically placed.

The bathing fixtures described may be constructed using known methods of manufacturing plastic articles. For example, a fixture may be sprayed up on a mold, applying first the gel-coat, then the magnetic layer, and finally the structural layer, using for example unsaturated polyester resins throughout. Alternately, thermoforming may be used, especially for a thermoplastic sheet as the show surface. Other lamination and/or forming methods, or combinations thereof, may be used, depending on choice of materials and the configuration of the bathing fixture.

Although the present invention and its advantages have been described in detail, it should be understood that various changes, substitutions, and alterations can be made herein without departing from the spirit and scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A plastic bathing fixture selected from a bathtub, a shower pan, a shower stall, and a unitary or multi-piece tub/shower combination, said fixture comprising a non-magnetic show-surface layer, a non-magnetic structural layer, and a magnetic or magnetizable subsurface layer in at least a portion of the fixture wherein the magnetic subsurface layer resides between the show-surface layer and the structural layer.

2. The bathing fixture of claim 1 wherein the magnetic or magnetizable subsurface layer is present substantially throughout the fixture.

3. The bathing fixture of claim 1 wherein said portion includes areas adjacent an access opening where a shower curtain might be used.

4. The bathing fixture of claim 1 wherein said magnetic subsurface layer comprises an organic resin mixed with particulate ferromagnetic metal filler.

5. The bathing fixture of claim 4 wherein said magnetic layer comprises from 30% to 90% by weight said ferromagnetic filler.

6. The bathing fixture of claim 4 wherein the magnetic layer is applied to the back side of the show surface and has a thickness of about 0.12 to 2.5 mm.

7. The bathing fixture of claim 4 wherein said ferromagnetic filler comprises iron, and said magnetic layer has a thickness of about 0.5 to 0.76 mm.

8. The bathing fixture of claim 1 wherein the magnetic subsurface layer comprises a ferromagnetic metal sheet.

9. The bathing fixture of claim 1 wherein the magnetic subsurface layer comprises a ferromagnetic metal mesh.

10. The bathing fixture of claim 1 wherein the magnetic subsurface layer comprises a fibrous ferromagnetic metal material in the form of a woven or non-woven fabric or a mesh or screen.

11. A bathing fixture formed substantially of a laminated composite material comprising: a non-magnetic show-surface layer of gel-coat or thermoplastic sheet material; a non-magnetic structural layer of fiber-reinforced resin material; and one or more magnets strategically placed behind the show-surface layer for holding or attracting a magnetic or magnetizable bath accessory wherein the one or more magnets reside between the show-surface layer and the structural layer.

12. The bathing fixture of claim 11 wherein said magnets reside adjacent an access opening where a shower curtain might be used.

13. A bathing system comprising a bathing fixture and a shower curtain;

said bathing fixture formed of a laminated composite material comprising: a non-magnetic show-surface layer of gel-coat or thermoplastic sheet material; a magnetic or magnetizable subsurface layer with a thickness of 0.12 to 2.5 mm in at least a portion of the fixture; and a non-magnetic structural layer of fiber-reinforced resin material;

said shower curtain having at least one magnet adapted in size and location to magnetically hold a portion of said curtain against said portion of said fixture wherein the subsurface layer is between the show-surface layer and the non-magnetic structural layer.

14. The fixture of claim 13 wherein said magnetic or magnetizable layer comprises an organic resin composition comprising from 30% to 90% by weight particulate ferromagnetic metal filler.

15. The bathing fixture of claim 14 wherein the ferromagnetic metal filler comprises iron with a particle size less than 325 mesh.

* * * * *